United States Patent [19]

Murakami et al.

[11] Patent Number: 4,754,724

[45] Date of Patent: Jul. 5, 1988

[54] DECK CONSTRUCTION OF A SMALL BOAT

[75] Inventors: Konomu Murakami, Yokohama; Hiroshi Nishida, Miki, both of Japan

[73] Assignee: Kawasaki Jukogyo Kabushiki Kaisha, Kobe, Japan

[21] Appl. No.: 865,106

[22] Filed: May 20, 1986

[30] Foreign Application Priority Data

May 20, 1985 [JP] Japan ..... 60-107852

[51] Int. Cl.[4] ..... B63B 17/00

[52] U.S. Cl. ..... 114/363; 114/270

[58] Field of Search ..... 114/363, 270; 297/345; 248/421; 440/42

[56] References Cited

U.S. PATENT DOCUMENTS

| | | | |
|---|---|---|---|
| 2,729,274 | 1/1956 | Boschetti et al. | 248/421 X |
| 3,475,773 | 11/1969 | Codman, Jr. | 114/363 X |
| 3,789,444 | 2/1974 | McCord | 114/363 |
| 3,826,220 | 7/1974 | Jacobson | 114/270 |
| 3,906,885 | 9/1975 | Woodfill | 440/42 |
| 4,030,436 | 6/1977 | Stoberl | 114/363 X |
| 4,442,787 | 4/1984 | Curran et al. | 114/363 |

FOREIGN PATENT DOCUMENTS

| | | | |
|---|---|---|---|
| 0186533 | 11/1982 | Japan | 297/345 |

*Primary Examiner*—Sherman D. Basinger

*Attorney, Agent, or Firm*—Poms, Smith, Lande & Rose

[57] ABSTRACT

A small boat deck construction is shown providing an adjustable seat mounting device. One embodiment presents the arrangement where the seat may be raised to an elevated position or lowered to a retracted position to minimize the space the seat occupies over the floor area. Two other embodiments disclose a seat being pivoted into position from the boat fins.

12 Claims, 5 Drawing Sheets

DECK CONSTRUCTION OF A SMALL BOAT

BACKGROUND OF THE INVENTION

The present invention relates to a deck construction of a small boat, particularly of the sports type for use off shore.

A boat of this type is designed to move at a high speed (50 kilometers/hour, for example), and has an engine in an engine room formed adjacent to the bow, and a propeller such as a jet flow pump mounted adjacent to the stern. The boat can be operated by one standing on a rear deck aft of the engine room, and manipulating a handle mounted adjacent to the engine room. The deck is formed with a pair of upwardly projecting side fins, which define a riding floor between them.

The prior art deck construction has no suitable seating means for one to comfortably operate the boat at low speed or for a long time.

Also, since the boat often rises from the water, the rear deck is required to have a shape and a construction which facilitates the rise.

It is a general object of this invention to provide a deck construction, which allows a small boat to be operated by one either standing or sitting on the deck, without affecting the ease of rise of the boat.

SUMMARY OF THE INVENTION

According to the invention, a deck construction is provided for a small boat including a hull, a handle supported on said hull adjacent the bow, a deck formed by said hull adjacent the stern, on which deck an operator can operate said handle, a pair of fins projecting upwardly from said deck and extending along both sides of said deck, a riding floor formed by said hull between said fins, and an open space formed over said floor between said fins.

The deck construction provides for a foldable seat means mounted on the hull and adapted to have a retracted position and an elevated seating position. When the seat means is retracted, it does not substantially occupy the space above the deck.

Preferred embodiments of the invention are explained below with reference to the accompanying drawings, wherein:

DETAILED DESCRIPTION

Figure 1:
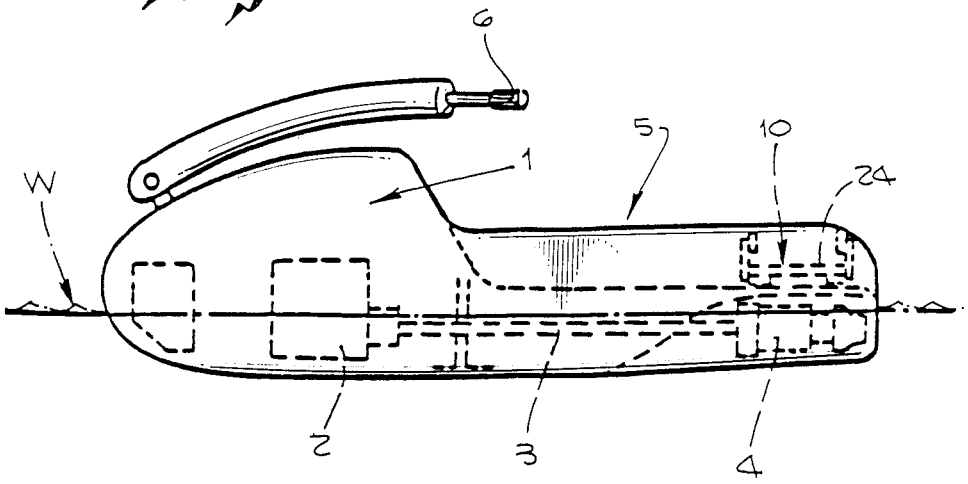
FIG. 1 is a side view of a small boat having a deck construction according to the first embodiment, with seat means lowered.
Figure 2:
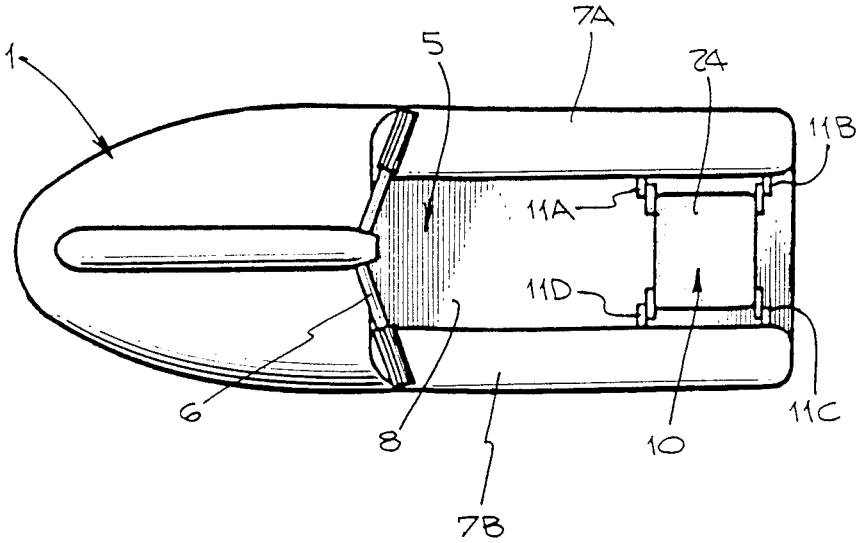
FIG. 2 is a top plan of the boat.

With reference to FIGS. 1 and 2, the boat's hull is fabricated from plastic, such as fiber-reinforced plastic, which forms an engine room 1 adjacent to the bow. The room 1 houses an engine 2 for driving a drive shaft 3 connected to a propeller 4 at the bottom of the stern. The hull also forms a rear deck 5 aft of the room 1, on which one can operate the boat by manipulating a handle 6.

In FIG. 1, the dash-dot line W indicates the water level.

With reference to FIGS. 1–4, the deck 5 is formed with a pair of hollow fins 7A,7B projecting upwardly and extending along its both sides, and a riding floor 8 for the operator between the fins 7A,7B. The fins 7A,7B have buoyancy for stabilizing the boat when not moving. Also, the fins 7A, 7B keep the operator from slipping off the floor 8, and function as wave barriers.

The deck 5 is provided with foldable seat means 10 between the fins 7A,7B at the stern.

Figure 3:
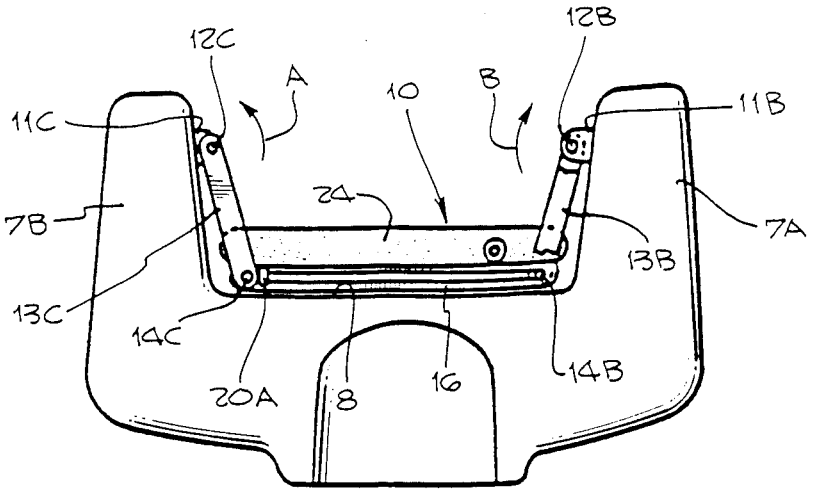
FIG. 3 is an enlarged rear view of the boat.

With reference to FIGS. 2–5, each fin 7A,7B has a pair of fore and aft brackets 11A–11D fixed to its inner wall. Pivotally connected to each bracket 11A–11D is link arm 13A–13D at its end by pin 12A–12D which extends longitudinally to the boat. Each arm 13A–13D is urged by a spring (not shown) in the rising direction A or B (FIG. 3). Each arm 13A–13D has another pin 14A–14D extending at its other end parallel to pin 12A–12D.

Figure 5:
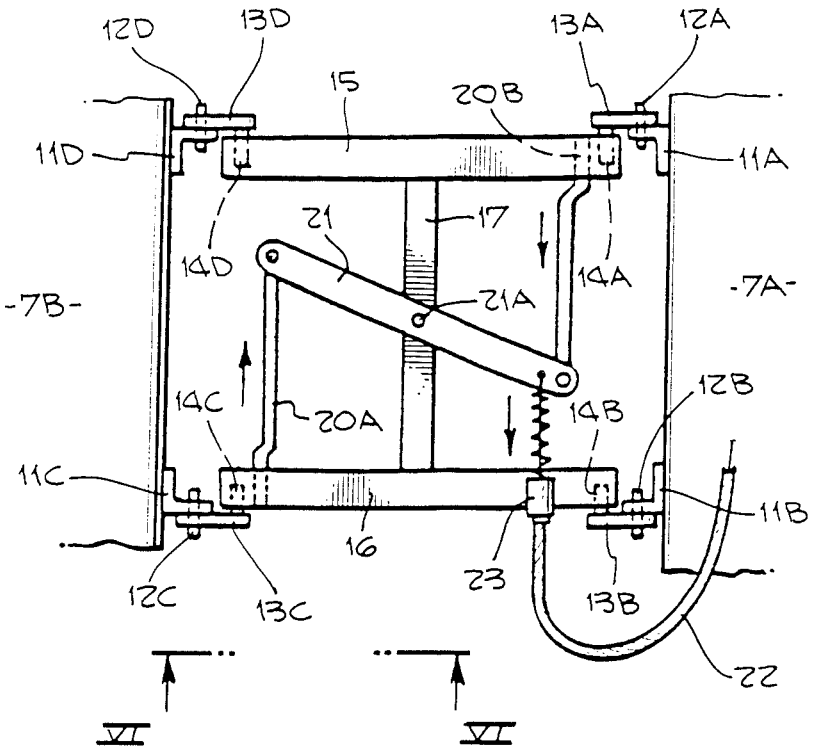
FIG. 5 is an enlarged fragmentary top plan showing the seat means with its seat removed.

As best shown in FIG. 5, the fore pins 14A,14D are bridged by a lateral guide member 15, and the aft pins 14B, 14C by another lateral guide member 16. The guides 15,16 are fixed together by a connecting member 17.

Figure 6:
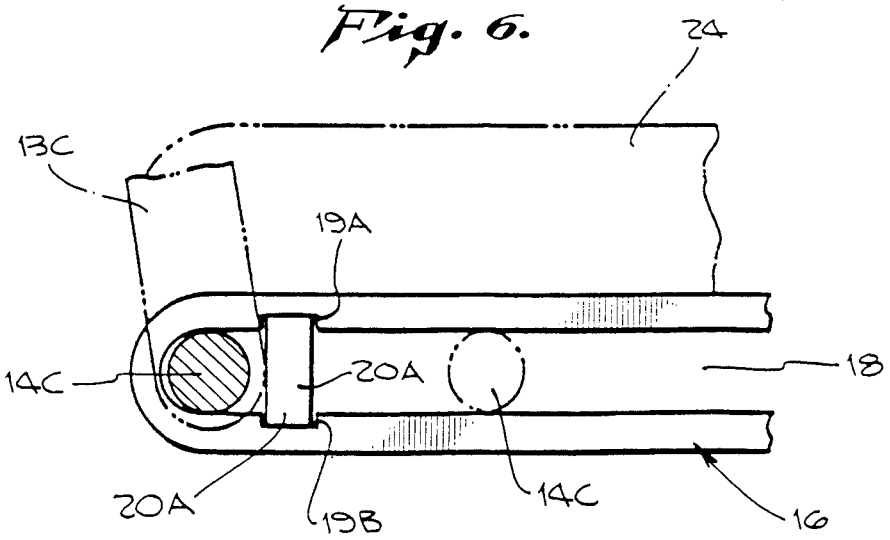
FIG. 6 is an enlarged fragmentary rear view taken at line VI—VI of FIG. 5.

As shown in FIG. 6, each guide 15,16 (15 not shown) is formed with a channel 18 along its length in slidable engagement with the pins 14C. The channel 18 is formed with a pair of upper and lower notches 19A, 19B adjacent to one end, with a space remaining outside the notches in the channel for occupation by the adjacent pin 14C.

Back to FIG. 5, the connector 17 supports a turning arm 21 pinned to its center at 21A. Pinned to each end of the arm 21 is a stopper 20A, 20B. The other end of the stopper 20A engages notches 19A, 19B on guide 16, preventing movement of the pin 14C along the channel 18.

Connected to one end of the turning arm 21 is a control cable 22, the outer case of which is fixed in position at one end by a cable guide 23 fixed to the aft guide 16. The other end of the outer case may be fixed to the handle. The cable 22 is biased so that the stoppers 20A, 20B normally engage the notches.

Figure 4:
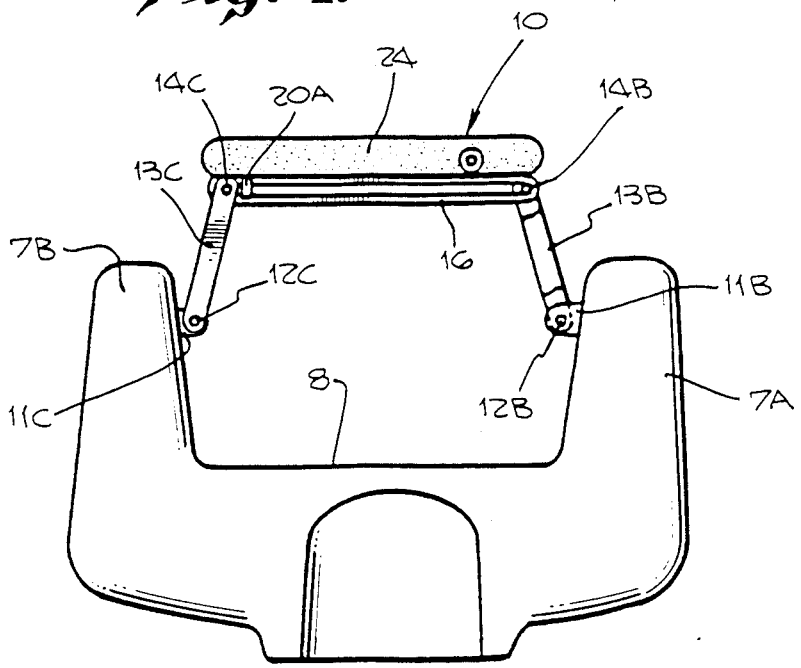
FIG. 4 is a view similar to FIG. 3, but with the seat means raised.

As shown in FIGS. 3, 4 and 6, a seat member 24 may be a cushioned board or a plastic board mounted on the guides 15, 16 by suitable means.

When the seat means 10 is not used, the control cable 22 is operated to retract the stoppers 20A, 20B partially or completely from the channels (FIG. 6) on the guides 15, 16 in the longitudinal directions indicated by the arrows in FIG. 5. This allows the pins 14A–14D to slide along the channels. The seat 24 can then be lowered against the spring force from the position in FIG. 4.

After the seat 24 is completely lowered to the position in FIG. 3, and the pins 14B,14C reach the end of the channel 18, the control cable 22 is released to engage the stopper 20A into the notches 19A, 19B. (The engagement of stopper 20B is not shown). As a result, the link arms 13B, 13C are locked into the lowered position as shown in FIG. 3.

When the seat means 10 is used, the control cable 22 is operated to retract the stoppers 20A, 20B thereby releasing the pins 14A–14D. This allows the spring force to raise the link arms 13A–13D and the seat 24 back to the position shown in FIG. 4. The cable 22 is then released to engage the stoppers 20A, 20B into the notches thereby locking the link arms 13A–13D in position.

When the seat means 10 is retracted, the operator's height on the riding floor 8 will be at a minimum, thereby facilitating the rise of the boat from the water. In this instance, since the seat 24 is positioned over the floor 8, the seat may be used as a pad for the operator when the boat rises.

Figure 7:
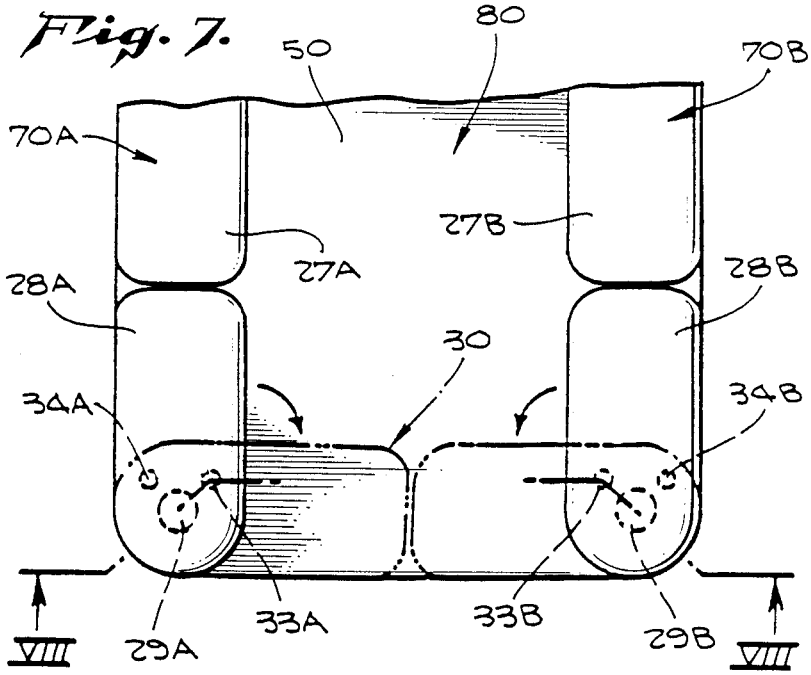
FIG. 7 is a fragmentary top plan of a deck construction according to the second embodiment.
Figure 8:
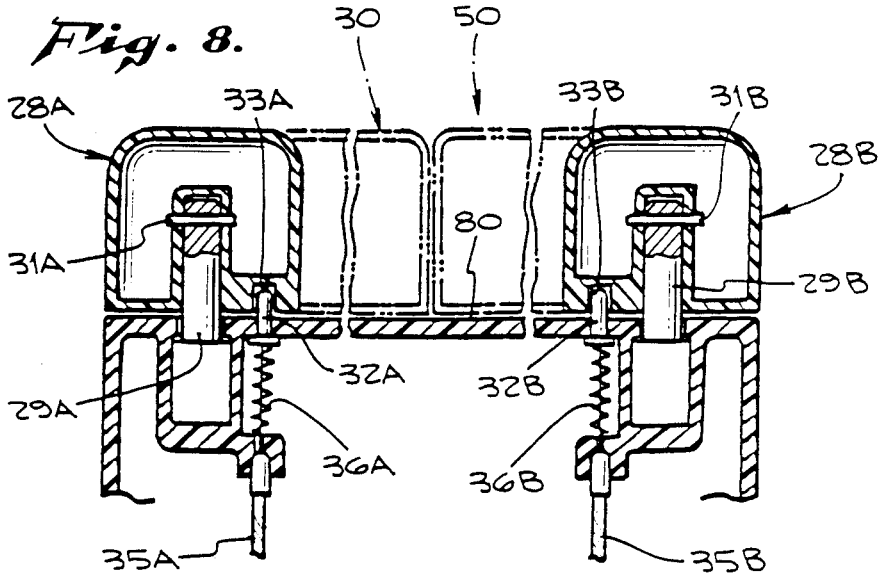
FIG. 8 is a slightly enlarged fragmentary view in cross section taken on line VIII—VIII of FIG. 7.

FIGS. 7 and 8 show the second embodiment, wherein the parts not shown are substantially the same as in FIGS. 1 and 2.

In FIGS. 7 and 8, a rear deck 50 is formed with a pair of hollow side fin sections 70A,70B, which project upwardly and define a riding floor 80 between them. Each fin section 70A, 70B includes a fixed find 27A, 27B, which is integral with the deck 50, and pivotal fin 28A, 28B aft of fin 27A, 27B.

The pivotal fins 28A, 28B have vertical shafts 29A, 29B which are fixed to there ends by pins 31A, 31B which project downwardly. The lower end shafts 29A, 29B rotatably engage a hole formed in the upper wall of the deck 50, which is flush with the floor 80, at each side. This allows the fins 28A, 28B to pivot around the shafts 29A, 29B on floor 80.

The pivotal fins 28A, 28B are formed with two pair of lock holes 33A, 33B, 34A, 34B in its lower surface, which are equally eccentric from shafts 29A, 29B and spaced from each other angularly at 45 degrees around the shaft. The holes 33A, 33B, 34A, 34B can be engaged by lock pins 32A, 32B.

Lock pins 32A, 32B are supported vertically and slidably at a fixed location on the deck 50, and connected to control cables 35A, 35B. These pins 32A,32B are biased by springs 36A, 36B so as to project toward deck 50, and can be retracted by manipulating cable 35A,35B. The other end of the cables 35A,35B may be supported by the handle 6 (See FIGS. 1 and 2). The cables 35A, 35B located on both sides may be operated by a single lever through a cable joint.

When the lock pins 32A, 32B engage the lock holes 33A, 33B, the pivotal fins 28A, 28B are locked in the retracted positions shown by solid lines. When the pins 32A, 32B engage holes 34A, 34B, the fins 28A, 28B are locked in the aligned end-to-end positions shown by the chain lines, where the fins 26A, 26B form a seat 30.

It is preferable to urge the pivotal fins 28A, 28B by springs (not shown) toward the retracted position, and provide stoppers (not shown) on the deck 50 to stop the fins 28A, 28B in this position.

The pivotal fins 28A,28B may be formed by molded hollow plastic filled with urethane foam for buoyancy, similarly the fixed fins 27A, 27B may be formed in the same manner or by a bottom plate, cushion material and a top cover for comfort.

In order to displace the pivotal fins 28A, 28B from the retracted to the aligned positions, the control cables 35A,35B are operated to retract the lock pins 32A, 32B from the holes 33A, 33B and then the fins 28A, 28B are turned inwardly. Subsequently, cables 35A, 35B are released so that, when the fins 28 have reached the aligned positions, the lock pins 32A, 32B project into holes 34A, 34B by the forces of the springs 36A, 36B to automatically lock the position of the fins 28A, 28B.

It should be understood that the fins 28A, 28B can be returned to their original positions and locked in the retracted positions in a similar manner.

The deck 50 could be designed to have a single pivotal fin, instead of the two fins 28A, 28B.

Figure 9:
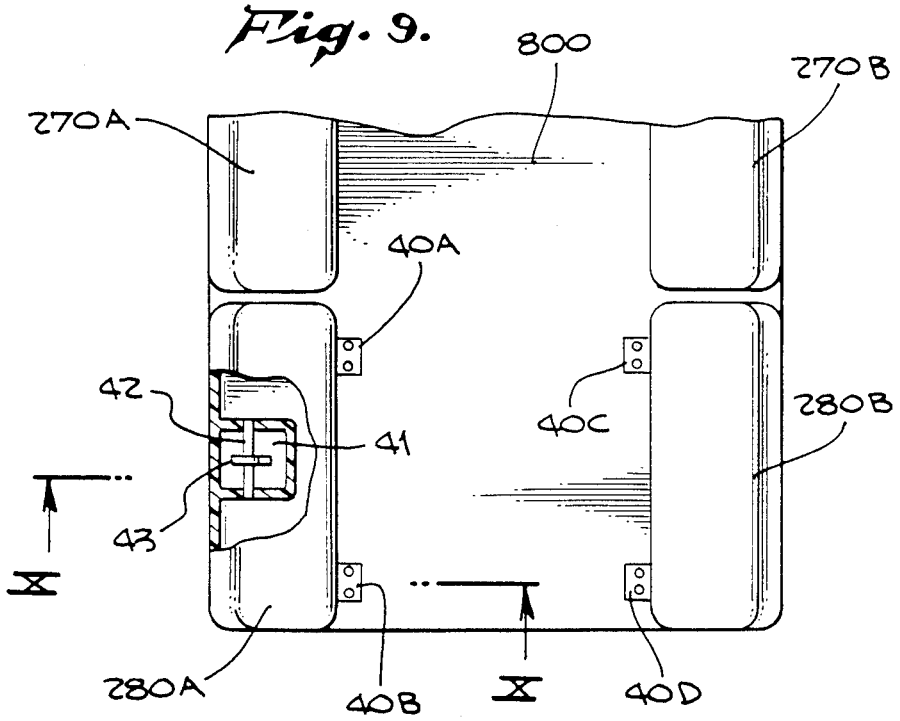
FIG. 9 is a fragmentary top plan of a deck construction according to the third embodiment.
Figure 10:
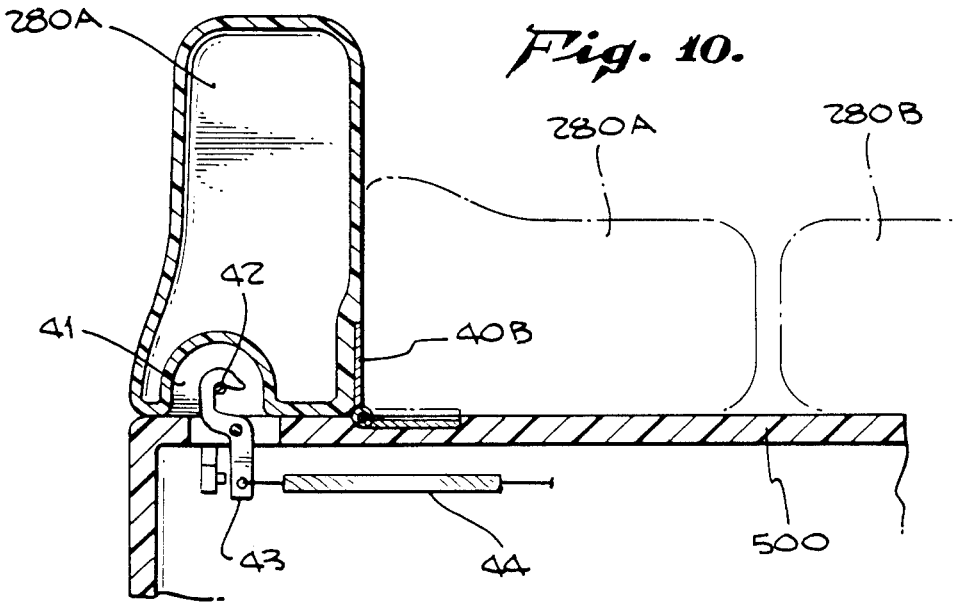
FIG. 10 is a slightly enlarged fragmentary view in cross section taken on line X—X of FIG. 9.

FIGS. 9 and 10 show the third embodiment, wherein the parts not shown are substantially the same as in FIGS. 1 and 2.

In FIGS. 9 and 10, similar to FIGS. 7 and 8, a rear deck 500 is formed with a pair of hollow side fin sections 7A,7B, which project upwardly and define a riding floor 800 between them. Each fin section 7A,7B includes a fixed fin 270A, 270B which is integral with deck 500, and a pivotal fin 280A, 280B aft of fins 270A, 270B.

The pivotal fins 280A, 280B are connected to the upper surface of the deck 500 by hinges 40A–40D at the bottom of the inner surfaces of fins 280A, 280B as shown in the upright position shown by the solid lines in FIGS. 9–10. The pivotal fins 280A, 280B are urged by springs (not shown) toward the seating or aligned end-to-end positions shown by chain lines on FIG. 10.

Each pivotal fin is formed with a recess 41 in its bottom surface. A lock bar 42 extends across the recess 41 and is fixed to the fin 280A. A latch or lock 43 is mounted pivotally on the deck 500, and engages the bar 42 when the fin 280A is in the upright position. The latch 43 is operable for unlocking through cable 44.

What is claimed is:

1. In a personal watercraft of the type having a partially submersible hull, a jet flow pump mounted adjacent to the stern, a handle supported on the hull adjacent the bow for operating the watercraft, a deck formed by the hull adjacent to the stern on which an operator can operate the handle in a sitting, standing, or kneeling position, a pair of fins projecting upwardly from the deck and extending along both sides of the deck comprising:

a seat extending substantially between said pair of fins; and a seat mounting means, affixed to said deck, for adjusting the position of said seat to an elevated position whereby said operator may sit upon said seat and operate said handle while seated and to a retracted position where said seat is adjacent to said deck whereby said operator may operate said watercraft in said kneeling and standing positions upon said seat.

2. The watercraft of claim 1, wherein said seat mounting means being connected to said fins.

3. The watercraft of claim 2 wherein said mounting means further comprises:

a guide member affixed to said seat having an elongated channel; and a linking member pivotally affixed to one of said fins at a first end and slidably connected to said elongated channel at a second end for facilitating the positioning of said seat between the elevated and retracted positions.

4. The watercraft of claim 3 wherein said mounting means further comprises:

stopping means for locking the seat in a fixed elevated position or in a fixed retracted position; and controlling means for controlling the engagement of said stopping means with said guide member.

5. The watercraft of claim 4 wherein said stopping means further comprises:

an elongated member normally biased to position a first end within said guide member to limit movement of said seat and having a second end connected to a biasing means.

6. A personal watercraft of the type having a hull, a jet flow pump mounted adjacent to the stern, a handle supported on the hull adjacent the bow for operating the watercraft, a deck formed by the hull adjacent to the stern on which an operator can operate the handle, a pair of fins projecting upwardly from the deck and extending along both sides of the deck comprising:

a seat extending substantially between said pair of fins;

a linking member pivotally connected to said seat and to one of said fins;

a seat mounting means, connected to said fins, for adjusting said seat to an elevated position whereby said operator may sit upon said seat and operate said handle while seated and to a retracted position where said seat is adjacent to said deck whereby said operator may operate said handle in kneeling and standing positions upon said seat;

said mounting means comprising at least one mounting bracket affixed to at least one of said fins and pivotally connected to said linking member;

said linking member being slidably connected to a guide member affixed to said seat; and a stopping means for locking the seat in a fixed elevated position or in a fixed retracted position.

7. In a personal watercraft having a hull, a jet flow pump mounted adjacent to the stern, a handle supported on the hull adjacent the bow for operating the watercraft, a deck formed by the hull adjacent to the stern on which an operator can operate the handle, a pair of fins projecting upwardly from the deck and extending along both sides of the deck, comprising:

a fixed fin portion and a pivotal fin portion on at least one of said fins;

pivoting means for pivoting said pivotal fin portion from a position extending along a side of said deck to a position forming a seating surface on said deck; and said seating surface extending substantially across said stern.

8. The watercraft of claim 7 further comprising:

controlling means for locking said pivotal fin portion in a first position or a second position.

9. The watercraft of claim 8 wherein said controlling means further comprises:

a biased locking pin to lock said pivotal fin into a fixed position by engaging a locking receptacle on said pivotal fin.

10. The watercraft of claim 7 wherein said pivoting means further comprises:

a vertical shaft for pivoting said pivotal fin from a first position to a second position.

11. The watercraft of claim 7 wherein said pivoting means further comprises:

hinging means for rotating said pivotal fin from a substantially vertical position to a horizontal position.

12. The watercraft of claim 11 further comprising:

controlling means for locking said pivotal fin portion in a first position.

* * * * *